US011105106B2

(12) United States Patent
Henikl et al.

(10) Patent No.: US 11,105,106 B2
(45) Date of Patent: Aug. 31, 2021

(54) LARGE MANIPULATOR WITH DECENTRALIZED HYDRAULIC SYSTEM

(71) Applicant: Schwing GmbH, Herne (DE)

(72) Inventors: Johannes Henikl, Essen (DE); Reiner Vierkotten, Oberhausen (DE); Andreas Lehmann, Moers (DE)

(73) Assignee: SCHWING GmbH, Herne (DE)

( * ) Notice: Subject to any disclaimer, the term of this patent is extended or adjusted under 35 U.S.C. 154(b) by 475 days.

(21) Appl. No.: 16/092,698

(22) PCT Filed: Apr. 10, 2017

(86) PCT No.: PCT/EP2017/058535
§ 371 (c)(1),
(2) Date: Oct. 10, 2018

(87) PCT Pub. No.: WO2017/178420
PCT Pub. Date: Oct. 19, 2017

(65) Prior Publication Data

US 2019/0161983 A1 May 30, 2019

(30) Foreign Application Priority Data

Apr. 11, 2016 (DE) ..... 10 2016 106 595.1

(51) Int. Cl.
*E04G 21/04* (2006.01)
*F15B 13/044* (2006.01)
(Continued)

(52) U.S. Cl.
CPC ..... *E04G 21/0463* (2013.01); *E04G 21/0436* (2013.01); *E04G 21/0454* (2013.01);
(Continued)

(58) Field of Classification Search
CPC ..... E04G 21/0436; E04G 21/0463; E04G 21/0454; F15B 15/202; F15B 13/0444
See application file for complete search history.

(56) References Cited

U.S. PATENT DOCUMENTS 6,256,986 B1 * 7/2001 Langen ..... F15B 11/003 60/462
6,282,893 B1 9/2001 Porter et al.

FOREIGN PATENT DOCUMENTS

CN 201924601 U 8/2011
CN 104863366 A 8/2015
(Continued)

*Primary Examiner* — Abiy Teka
(74) *Attorney, Agent, or Firm* — Faegre Drinker Biddle & Reath LLP

(57) ABSTRACT

A manipulator includes an articulated boom configured to be folded out. The articulated boom includes a turntable that can be rotated about a vertical axis, a plurality of boom segments, electrically-actuated proportional valves, and a remote control. The boom segments are pivotable via respective drive assemblies. The electrically-actuated proportional valves are respectively arranged directly on or in proximity to the respective drive assemblies to be controlled. The remote control includes at least one control lever configured to be displaced in a plurality of actuating directions. The manipulator further includes an electronic controller configured to actuate the drive assemblies via a travel command. The travel command indicates a desired movement of the boom tip. The travel command is generated in response to displacement of the control lever into at least one of the plurality of actuating directions. And, the travel command causes actuation of the respective electrically-actuated proportional valves.

8 Claims, 2 Drawing Sheets

Figure 1:
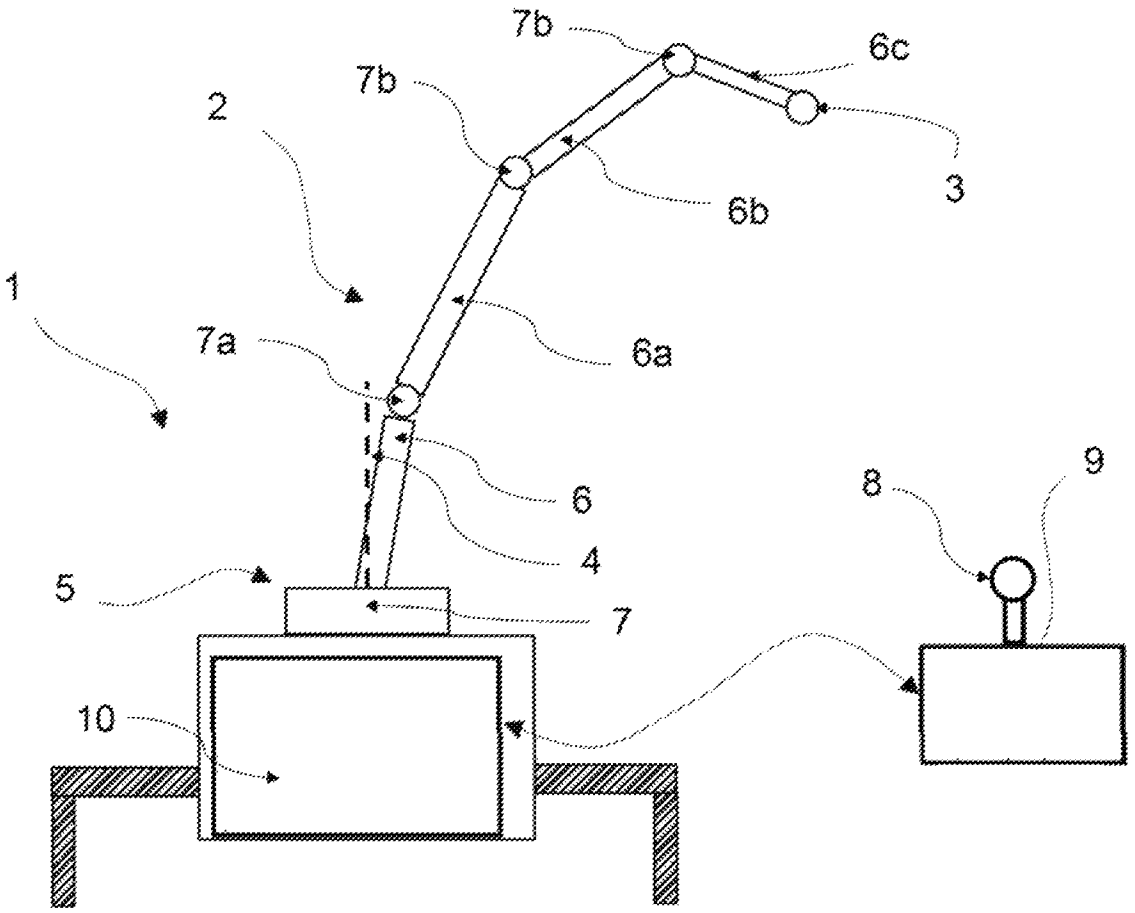

(51) Int. Cl.

| | |
|---|---|
| ***F15B 15/20*** | (2006.01) |
| ***F15B 11/16*** | (2006.01) |
| ***F15B 13/02*** | (2006.01) |
| ***F15B 13/04*** | (2006.01) |
| ***F15B 20/00*** | (2006.01) |
| ***F15B 21/00*** | (2006.01) |

(52) U.S. Cl.

CPC ..... *F15B 11/16* (2013.01); *F15B 13/027* (2013.01); *F15B 13/0416* (2013.01); *F15B 13/0444* (2013.01); *F15B 15/202* (2013.01); *F15B 20/00* (2013.01); *F15B 21/008* (2013.01); *F15B 2211/20576* (2013.01); *F15B 2211/30515* (2013.01); *F15B 2211/30565* (2013.01); *F15B 2211/327* (2013.01); *F15B 2211/6313* (2013.01); *F15B 2211/8613* (2013.01); *F15B 2211/8633* (2013.01); *F15B 2211/8636* (2013.01)

(56) References Cited

FOREIGN PATENT DOCUMENTS

| | | | | | |
|---|---|---|---|---|---|
| DE | 4306127 | A1 | | 9/1994 | |
| DE | 19520166 | A1 | | 11/1995 | |
| EP | 2347988 | A1 | | 7/2011 | |
| WO | WO-2013132303 | A1 | * | 9/2013 | ..... E04G 21/0454 |
| WO | 2014165889 | A1 | | 10/2014 | |

* cited by examiner

LARGE MANIPULATOR WITH DECENTRALIZED HYDRAULIC SYSTEM

CROSS-REFERENCE TO RELATED APPLICATION

This application is a U.S. 371 Application of International Application No. PCT/EP2017/058535, filed Apr. 10, 2017, which claims priority to Germany Patent Application No. 10 2016 106 595.1, filed Apr. 11, 2016, both of which are herein incorporated by reference in their entireties.

The invention relates to a manipulator, in particular a large manipulator for truck-mounted concrete pumps, comprising an articulated boom which can be folded out and which has a turntable that can be rotated about a vertical axis and a plurality of boom segments, wherein the boom segments can be pivoted to a limited degree about respective articulation axes at articulation joints relative to an adjacent boom segment or relative to the turntable by means of a respective drive assembly, and comprising a remote control device having at least one control lever, wherein the control lever can be displaced in a plurality of actuating directions, and comprising a control device for actuating the drive assemblies.

Such a manipulator is known from EP 0 686 224 B1. In general, these manipulators are controlled via a hydraulic control circuit including a central mast control block and lowering brake valves mounted on the individual drive assemblies to guarantee the load holding function. However, this configuration is disadvantageous, in particular with respect to the response behavior of the manipulator. Due to the substantial cable lengths between the lowering brake valves and the control valves in the central boom control block, and also due to the dynamic behavior of the lowering brake valves, noticeable delays occur in these hydraulic control circuits between the displacement of the control lever in an actuating direction and the execution of a movement by the drive assemblies at the individual articulation joints. This delay is generally not identical for all articulation joints, but instead differences arise caused by the different cable lengths between the lowering brake valves and the control valves, and also due to pressure conditions and the requested movement speed. Particularly at the beginning of a movement of the manipulator, initiated by the displacement of the control lever in an actuating direction, these delays are highly disadvantageous, in particular if a plurality of articulation joints are to operate simultaneously during this initiated movement in order to execute the requested movement. The differences of the individual articulation joints with respect to response behavior may then generate undesired pivoting movements of the boom into unintended directions, particularly at the beginning of a movement. In particular at low speeds of pivotal movement of the individual articulation joints, conventional lowering brake valves often lead to non-uniform, undefined movement, because the open state of the lowering brake valves is ambiguous at these low speeds. In this case, the executed movement does not correspond to the specification by the control lever. As a result, response behavior and precision are substantially compromised, in particular at low speeds of pivotal movement.

It is therefore the object of the invention to provide a manipulator, which alleviates the described disadvantages and facilitates simple operation and excellent response behavior.

This problem is solved by a manipulator according to claim 1. Thus, because the control unit converts a travel command, which indicates a desired movement of the boom tip of the articulated boom or of an end tube attached to the boom tip, for example, in a direction in Cartesian or polar coordinate systems, wherein the travel command can be generated by displacing the control lever into at least one actuating direction, into movement specifications for the drive assemblies, and the drive assemblies can be actuated by means of a respective electrically actuated proportional valve which is connected to hydraulic control lines of the respective drive assembly in order to actuate the same, and at least one proportional valve is arranged directly on or in direct proximity to the drive assemblies to be controlled, a manipulator may be realized that guarantees excellent response behavior. The at least one proportional valve is arranged directly on an assigned drive assembly to be controlled, i.e., at the mounting point of the drive assembly. Thus, the at least one proportional valve may be arranged on the drive assembly to be controlled in such a manner that the proportional valve, together with the drive assembly on the boom segment of the articulated boom, changes its position with respect to the turntable or the concrete pump. Due to the direct arrangement of the proportional valve on the assigned drive assembly to be controlled, the length of the control lines between the proportional valve and the drive assembly may be significantly reduced, by which means the response behavior of the manipulator is improved and the manipulator may be operated more dynamically and with greater agility.

The effect that the invention achieves is most distinct if all proportional valves are arranged in proximity to the drive assemblies to be controlled. However, a very significant improvement of the response behavior of the manipulator often already results even with the arrangement of at least one proportional valve in proximity to one drive assembly to be controlled. The more proportional valves that are arranged in proximity to the drive assemblies to be controlled, however, the better the ultimate response behavior of the manipulator to control commands.

Advantageous embodiments and refinements of the invention arise from the dependent claims.

According to one advantageous embodiment of the invention, the travel command indicates a desired movement of the boom tip of the articulated boom or of an end tube attached to the boom tip in a direction in Cartesian or polar coordinate systems. A particularly simple operation of the manipulator is thus possible.

It is particularly advantageous that the at least one proportional valve is actuatable using a stepper motor. A manipulator may thus be realized that guarantees excellent response behavior of the boom segments. In addition, proportional valves actuatable by a stepper motor are significantly lighter and smaller than conventional valves with similar outputs that use proportional magnets, which facilitates significant weight savings and a reduction in the required installation space. Due to the particularly small size and the low weight of the at least one proportional valve, this is particularly suited for a decentralized hydraulic control circuit.

According to one advantageous embodiment of the invention, the at least one proportional valve has a housing which contains a valve piston, a reset spring, and the stepper motor. A proportional valve of this type is simply designed and not susceptible to malfunctions, which is particularly advantageous for use in manipulators. In particular, if the proportional valve is arranged directly on the assigned drive assembly to be controlled, where the proportional valve may be difficult to reach for repairs.

One particularly advantageous embodiment of the invention provides that the valves used for load holding function are designed as hydraulic, pilot-operated check valves. This provides large dynamic advantages, in particular for the implementation of active vibration damping, as these valves provide particularly good response behavior.

One possible embodiment is additionally advantageous, in which the setting of the check valves can be changed by the first control unit and/or another control unit, independent of the setting of the at least one proportional valve arranged directly on an assigned drive assembly to be controlled. By this means, it is possible to significantly improve the response behavior of the large manipulator, in particular during realization of the load holding function. It has been shown that electronic actuation of the check valves ensures a defined open state even at low speeds of pivotal movement in the articulation joints.

It is particularly advantageous if the manipulator has a hydraulic emergency circuit parallel to the at least one proportional valve, wherein the emergency circuit preferably contains at least one controllable switching valve, which is arranged directly on or in direct proximity to the drive assembly to be controlled and is preferably supplied via its own pressure supply line, and hydraulic pilot-operated check valves or lowering brake valves for achieving a load holding function. By this means, the manipulator may also be controlled even if the proportional valve fails.

One embodiment is particularly advantageous in which the control unit is designed for active vibration damping, wherein the control unit generates actuating signals for the drive assemblies to damp vibrations of the articulated boom.

This has particular advantages during operation of the manipulator, because vibrations of the articulated boom may be better damped through direct actuation of the at least one proportional valve by the control unit with respect to the prior art.

According to one advantageous embodiment of the invention, the conversion of the movement specifications into actuation signals for the at least one proportional valve, arranged directly on an assigned drive assembly to be controlled, is carried out by a local control unit. By this means, the electric cabling expense or the utilization of the BUS system used is substantially reduced.

Additional features, details, and advantages of the invention arise based on the subsequent description and by way of the drawings. One exemplary embodiment of the invention is depicted in a purely schematic manner in the following drawings and is described in greater detail below. Mutually corresponding subject matter is provided with identical reference numerals in all figures. As shown in:

FIG. 1 a manipulator according to the invention, and

Figure 2:
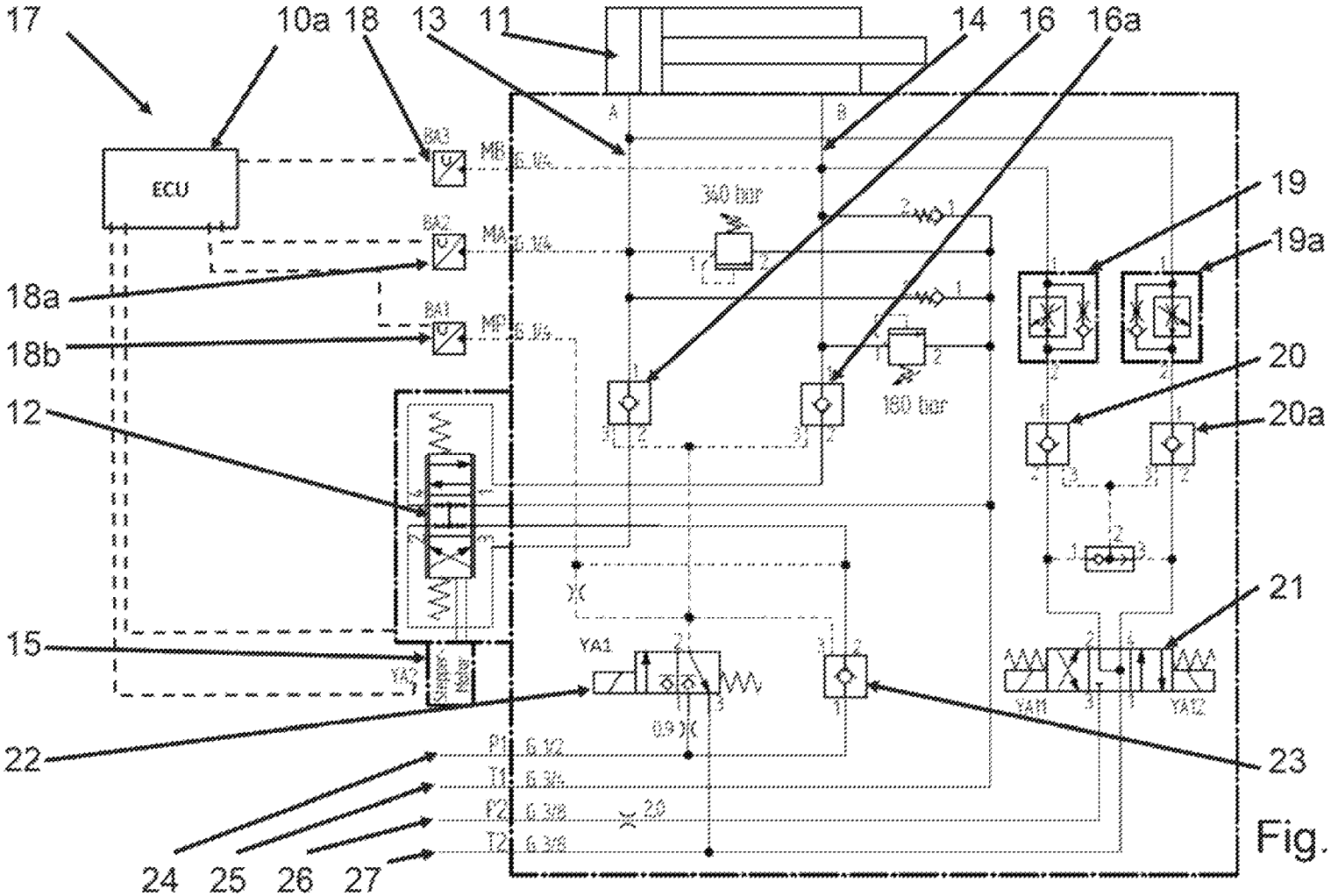

FIG. 2 a wiring diagram for a control circuit for a hydraulic drive assembly of the manipulator.

FIG. 1 schematically depicts a manipulator 1 according to the invention, in particular a large manipulator for truck-mounted concrete pumps, comprising an articulated boom 2 which can be folded out and which has a turntable 5 that can be rotated about a vertical axis 4 and a plurality of boom segments 6, 6*a*, 6*b*, 6*c*. Boom segments 6, 6*a*, 6*b*, 6*c* are pivotable to a limited degree about respective articulation axes at articulation joints 7, 7*a*, 7*b* relative to an adjacent boom segment 6, 6*a*, 6*b*, 6*c* or relative to turntable 5 by means of a respective drive assembly 11 (FIG. 2). Movement specifications may be transmitted to a central control unit 10 using a control lever 8 on a remote control device 9, which may be displaced in a plurality of actuating directions. This may, for example, be a desired movement of the boom tip 3 of articulated boom 2 or of an end tube attached to the boom tip. For this purpose, control lever 8 is displaced into an actuating direction and central control unit 10 receives the generated travel command. Central control unit 10 converts the travel command into movement specifications for individual drive assemblies 11 (FIG. 2). For this purpose, the position of manipulator 1, detected using measurement technology, for example, by inclination sensors on boom segments 6, 6*a*, 6*b*, 6*c* or rotation angle sensors in articulation joints 7, 7*a*, 7*b*, is processed by central control unit 10.

FIG. 2 shows a schematic representation of an electro-hydraulic control circuit 17 for actuating a hydraulically actuated drive assembly 11 by means of which a boom segment 6, 6*a*, 6*b*, 6*c* (FIG. 1) of manipulator 1 (FIG. 1) is displaceable with respect to its orientation, comprising an electrically actuated proportional valve 12 which is connected to hydraulic control lines 13, 14 of drive assembly 11 for actuating the same. For a better overview, only control circuit 17 for one drive assembly 11 is shown in FIG. 2, wherein each drive assembly 11 is provided with its own control circuit 17 on at least one articulation joint or, in the preferred embodiment of the invention shown in FIG. 2, on each articulation joint.

The invention will subsequently be described by way of this preferred embodiment. Mixed forms, in which individual proportional valves for some articulation joints are part of a central hydraulic control block according to the prior art and the remaining proportional valves are arranged on or in proximity to the drive assembly, are possible and improve the controllability of the manipulator.

Proportional valves 12 assigned to individual drive assemblies 11 are arranged parallel to one another on first pressure supply (P1) 24 and on the first return flow (T1) 25. Proportional valve 12 is actuatable using a stepper motor 15, wherein proportional valve 12 has a housing that contains a valve piston, a reset spring, and stepper motor 15. The actuation of the valve piston on proportional valve 12 is carried out via a rack by means of stepper motor 15. A monitoring unit for monitoring the increments carried out by stepper motor 15 is provided on stepper motor 15. In order to be able to reproduce the position in which proportional valve 12 is located, a memory is additionally provided for storing the increments carried out by stepper motor 15. The actuation by means of stepper motor 15 facilitates a precise adjustment of proportional valve 12 independent from the flow forces that occur, which facilitates a particularly precise control of drive assembly 11 and sustainably improves the response behavior of manipulator 1 (FIG. 1).

Electrically actuated proportional valve 12 is also clear in FIG. 2, by means of which drive assembly 11, in particular the hydraulic cylinder, may be displaced in that proportional valve 12 applies a pressure difference to control lines 13, 14 assigned to drive assembly 11. For this purpose, control lines 13, 14 are each selectively connected to a first pressure supply (P1) 24 or to a first return flow (T1) 25 by proportional valve 12. The actuation of proportional valve 12 is carried out by a local electronic control unit (ECU) 10*a* via an assigned stepper motor 15. Said electronic control unit monitors and controls the state of local electro-hydraulic control circuit 17 including associated drive assembly 11, facilitates the implementation of complex algorithms, provides an interface for external communication via a BUS system (for example, CAN), and the possibility of connecting a plurality of sensors, e.g., inclination sensors on the boom segments, rotational angle sensors in the articulation joints, or pressure sensors for detecting the pressures in the control lines, with said interface. In addition, control device

10*a* receives the movement specification, transmitted by central control device 10 (FIG. 1), said movement specification being calculated by central control device 10 (FIG. 1) using the travel command generated by the displacement of control lever 8 (FIG. 1), for the associated drive assembly and processes said travel command into an actuation signal for proportional valve 12, wherein this is thereby switched and actuates drive assembly 11. Depending on the setting of proportional valve 12, a supply pressure assigned to pressure supply (P1) 24 is switched to control line 13 or 14 of assigned drive assembly 11. Stop valves 16, 16*a* fulfill a load holding function when control circuit 17 is in an inactive state or is in a safe state. Said stop valves 16, 16*a* are designed as hydraulic pilot-operated check valves 16, 16*a*, which may be opened and closed by local control device 10*a* independent of the setting of proportional valve 12. Stop valve 23 likewise has a safety function, in particular, it prevents the pushing open of stop valves or check valves 16, 16*a* in the case that a valve piston jams outside of the center position in proportional valve 12. In addition, using sensors 18, 18*a*, 18*b*, the supply pressure of supply line P1 is measured by sensor 18 in the active state of electro-hydraulic control circuit 17, and the pressures in control lines 13, 14 to hydraulic drive assembly 11 are measured by sensors 18*a*, 18*b*. These measurements are utilized by local controller 10*a* for determining each target setting of proportional valve 12, which quasi statistically leads to a desired volume flow or the implementation of movement specifications, transmitted by central controller 10, for hydraulic drive assembly 11. Electro-hydraulic control circuit 17 in the embodiment shown additionally comprises an optional hydraulic emergency circuit for emergency operation switched in parallel to proportional valve 12. This emergency circuit facilitates an operation of drive assembly 11 in the case of failure of (upstream or downstream) components assigned to proportional valve 12. A dedicated emergency circuit is preferably assigned to each proportional valve 12 for controlling a drive assembly 11. The emergency circuit comprises a control valve 21 for controlling the movement direction of drive assembly 11 in emergency operation and two mutually coupled valves 20, 20*a* which are designed as hydraulic pilot-operated check valves or lowering brake valves 20, 20*a* in conventional wiring. The travel speed may be limited in emergency operation using downstream adjustable throttles 19, 19*a*. Drive assembly 11, in particular the hydraulic cylinder, may thus be moved in emergency operation, in that control valve 11 for emergency operation applies a pressure difference to control lines 13, 14 assigned to drive assembly 11. For this purpose, control lines 13, 14 are each selectively connected to a second pressure supply (P2) 26 or to a second return flow (T2) 27 by control valve 21. In emergency operation, the pressure supply of drive assembly 11 preferably occurs via separate pressure supply (P2) 26 and separate return flow (T2) 27, so that in case of leakage in pressure supply (P1) 24 or return flow (T1) 25, a control of drive assembly 11 remains possible. By this means, it may be guaranteed that in the case of failure of the regular boom control including proportional valve 12, boom 2 (FIG. 1) may still be moved, for example, in order to retract boom 2 (FIG. 1) and if necessary to pump the residual concrete out of the concrete pump and out of the conveying tubes. Control valves 21 assigned to each proportional valve 12 are arranged parallel to one another on a separate pressure supply (P2) 26 and on separate return flow (T2) 27. Local electronic control device 10*a* additionally monitors the state and the behavior of control circuit 17 by means of the available sensors. As soon as local electronic control device 10*a* detects a fault, it automatically switches control circuit 17 into a safe state.

Alternatively, the tasks of local control units 10*a* may be taken on directly by central control unit 10 so that local control units 10*a* may be omitted. However, this has the disadvantage that the electric cabling expense or the utilization of the BUS system used is substantially increased. It would also be conceivable in the sense of a compromise to combine a plurality of local control units together so that these take on the control of more than one drive assembly in each case.

A configuration, in which the check valves switch into a defined open state, is also advantageous. The manipulator may also be easily and safely operated by the user at the control lever, even at low speeds of pivotal movement in the individual articulation joints, by means of this defined open state.

By minimizing and shortening the hydraulic control lines between proportional valves 12 and hydraulic drive assembly 11, and the defined open state of valves 16, 16*a* for the load holding function, which is independent of the setting of proportional valve 12 and the pressure ratios that occur, an optimal response behavior is achieved for the individual drive assemblies 11 with minimized delay time between the displacement of control lever 8 into an actuating direction and the execution of a movement by drive assemblies 11. In particular, this delay time is approximately identical for all drive assemblies 11 of articulated boom 2, so that upon initiating a movement of articulated boom 2 using simultaneous actuation of a plurality of drive assemblies 11, the movement may be implemented very precisely without undesired pivoting movements of articulated boom 2 into unintended directions at the beginning of the movement.

LIST OF REFERENCE NUMERALS

1 Manipulator
2 Articulated boom
3 Boom tip
5 Vertical axis
5 Turntable
6, 6*a*, 6*b*, 6*c* Boom segments
7, 7*a*, 7*b* Articulation joints
8 Control lever
9 Remote control device
10 Central control unit
10*a* Local control unit(s)
11 Drive assembly
12 Proportional valve
13 Control line A
14 Control line B
15 Stepper motor
16, 16*a* Load holding valves/Stop valves
17 Control circuit
18, 18*a*, 18*b* Pressure sensors
19, 19*a* Adjustable throttles
20, 20*a* Lowering brake valves (check valves)
21 Control valve
22 Release valve
23 Stop valve
24 Pressure supply (normal operation)
25 Return flow (normal operation)
26 Pressure supply (emergency operation)
27 Return flow (emergency operation)

The invention claimed is:

1. A manipulator comprising:

an articulated boom configured to be folded out and including:

a turntable that can be rotated about a vertical axis, a plurality of boom segments, the boom segments are pivotable about respective articulation axes at articulation joints relative to an adjacent boom segment or relative to the turntable via respective drive assemblies, the drive assemblies each coupled to hydraulic control lines, wherein a last of the boom segments of the plurality of boom segments includes a boom tip, electrically-actuated proportional valves respectively arranged directly on or in proximity to the respective drive assemblies to be controlled and respectively coupled to the hydraulic control lines of the respective drive assembly, and hydraulic, pilot-operated check valves operably coupled between the respective drive assemblies and the electrically-actuated proportional valves for a load-holding function;

a remote control having at least one control lever, the control lever configured to be displaced in a plurality of actuating directions; and an electronic controller configured to actuate the drive assemblies via a travel command, wherein the travel command indicates a desired movement of the boom tip or of an end tube attached to the boom tip, wherein the travel command is generated in response to displacement of the control lever into at least one of the plurality of actuating directions, and wherein the travel command causes actuation of the respective electrically-actuated proportional valves.

2. The manipulator of claim 1, wherein the travel command indicates a desired movement of the boom tip of the articulated boom or of the end tube attached to the boom tip in a direction in Cartesian or polar coordinate systems.

3. The manipulator of claim 1, wherein at least one of the electrically-actuated proportional valves is actuatable using a stepper motor.

4. The manipulator of claim 3, wherein the at least one of the electrically-actuated proportional valves includes a housing, which contains a valve piston, a reset spring, and the stepper motor.

5. The manipulator of claim 1, wherein the electronic controller is configured to set the check valves independent of setting of the electrically-actuated proportional valves.

6. The manipulator of claim 1, wherein at least one of the electrically-actuated proportional valves includes a hydraulic emergency circuit parallel to the same, wherein the hydraulic emergency circuit includes:

at least one controllable switching valve arranged directly on or in proximity to the respective drive assembly to be controlled and is supplied via its own pressure supply line, and the hydraulic pilot-operated check valves.

7. The manipulator of claim 1, wherein the electronic controller is configured to generate actuation signals for the drive assemblies to damp vibrations of the articulated boom.

8. The manipulator of claim 1, further comprising a local electronic controller configured to receive the travel command and convert the travel command into actuation signals for the electrically-actuated proportional valves.

* * * * *